US006846054B2

(12) United States Patent
Ishinaga et al.

(10) Patent No.: US 6,846,054 B2
(45) Date of Patent: Jan. 25, 2005

(54) LIQUID DISCHARGING METHOD, IMAGE FORMING METHOD, LIQUID DISCHARGE APPARATUS, AND LIQUID DISCHARGE HEAD

(75) Inventors: Hiroyuki Ishinaga, Tokyo (JP); Fumihiro Gotoh, Kanagawa (JP); Masao Kato, Tochigi (JP); Akitoshi Yamada, Kanagawa (JP); Hiroyuki Sugiyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 302 days.

(21) Appl. No.: 09/985,998

(22) Filed: Nov. 7, 2001

(65) Prior Publication Data

US 2002/0085048 A1 Jul. 4, 2002

(30) Foreign Application Priority Data

Nov. 10, 2000 (JP) ..... 2000-343749

(51) Int. Cl.[7] ..... B41J 2/05; B41J 2/14

(52) U.S. Cl. ..... 347/5; 347/9; 347/10; 347/11; 347/12; 347/13

(58) Field of Search ..... 347/5, 9, 10, 11, 347/12, 13

(56) References Cited

U.S. PATENT DOCUMENTS

| | | | | |
|---|---|---|---|---|
| 4,345,262 | A | 8/1982 | Shirato et al. | 346/140 R |
| 4,491,851 | A | 1/1985 | Mizuno et al. | 346/1.1 |
| 4,620,196 | A | 10/1986 | Hertz et al. | 346/1.1 |
| 4,686,539 | A | 8/1987 | Schmidle et al. | 346/1.1 |
| 6,092,887 | A | 7/2000 | Tanino et al. | 347/37 |
| 6,139,139 | A | 10/2000 | Stoffel et al. | 347/96 |
| 6,409,296 | B1 * | 6/2002 | Misumi et al. | 347/11 |

FOREIGN PATENT DOCUMENTS

| | | |
|---|---|---|
| EP | 0526233 A2 | 2/1993 |
| EP | 0610096 A2 | 8/1994 |
| EP | 0956961 A2 | 11/1999 |
| EP | 0982136 A2 | 3/2000 |
| EP | 0982136 A3 | 8/2000 |
| EP | 0982136 A2 | 8/2000 |
| EP | 1 072 419 A2 | 1/2001 |
| JP | 59-31944 | 8/1984 |
| JP | 61-206662 | 9/1986 |
| JP | 6-24871 | 4/1994 |
| JP | 7-285222 | 10/1995 |
| JP | 9-1790 | 1/1997 |
| JP | 10-193649 | 7/1998 |
| JP | 2001-96769 | 4/2001 |

OTHER PUBLICATIONS

In re Dalton and Cooley, 89 USPQ 271.*
In re Mason, 114 USPQ 127.*

* cited by examiner

*Primary Examiner*—Huan Tran
(74) *Attorney, Agent, or Firm*—Fitzpatrick, Cella, Harper & Scinto

(57) ABSTRACT

A liquid discharging method is disclosed for a liquid discharge head which includes a discharge port constituting the portion for discharging liquid, an energy generating element generating the energy for discharging liquid, and liquid flow paths communicating with the discharge port and equipped with the energy generating element, which forms a plurality of droplets by discharging the liquid from the discharge port by the energy of the energy generating element, and which performs recording by shooting the plurality of droplets onto a recording medium. Herein, the plurality of dots is formed of a main droplet which flies at the start; and a droplet formed by coalescing, after capturing, a plurality of satellite droplets which is discharged as a result of the discharge action of the main droplet, before the satellite droplets have been shot onto the recording medium.

18 Claims, 11 Drawing Sheets

HIGH-SPEED REFILL

BRAKING

HIGH-SPEED REFILL

BRAKING

CONVENTIONAL ART
EMBODIMENT

BLACK DOT FORMING POSITION

CYAN DOT FORMING POSITION

MAGENTA DOT FORMING POSITION

YELLOW DOT FORMING POSITION

DOT FORMATION ON PAPER

CONVENTIONAL ART

BLACK DOT FORMING POSITION

CYAN DOT FORMING POSITION

MAGENTA DOT FORMING POSITION

YELLOW DOT FORMING POSITION

DOT FORMATION ON PAPER

LIQUID DISCHARGING METHOD, IMAGE FORMING METHOD, LIQUID DISCHARGE APPARATUS, AND LIQUID DISCHARGE HEAD

BACKGROUND OF THE INVENTION

1. Field of the Invention

The present invention relates to on-demand type method and apparatus for discharging liquid, and particularly, to a method and an apparatus or a head for discharging liquid which are capable of using satellite droplet groups in the same manner as a main droplet in an appropriately discharged state, and which achieve a high-speed and high-frequency discharge. The present invention further relates to a liquid discharging method, an image forming apparatus, a liquid discharge apparatus, and a liquid discharge head which can be used for the entire spectrum of the technical field including printers which uses various liquids by bringing them into minute droplets.

2. Description of the Related Art

Hitherto, conventional arts of forming droplets have been broadly classified into the continuous discharge system and the on-demand system. As disclosed in Japanese Examined Patent Application Publication No. 6-24871, the former system pressurizes liquid into a high pressure and brings a discharged liquid column into minute droplets by means of electrolysis, and employs a large head which separates the droplets from electrically charged liquid by an electric field control. On the other hand, the latter system uses a small head which discharges droplet-shaped liquids in a drive timing by means of an electrothermal transducer, an electromechanical transducer, or the like.

In recent years, in the on-demand system, high-quality images has been developed for commercial use by the techniques of bringing color droplets into minute droplets. Among these techniques for bringing color droplets into minute droplets, there is a method which is applied by the same assignee as this application and in which a bubble is made to communicate with atmosphere, a method in which merely the size-reduction of a discharge port is conducted. To say nothing of these techniques of bringing color droplets into minute droplets, in the droplet discharging method, there occurs a plurality of minute droplets, named "satellite droplets", which are smaller in the size and lower in the speed than a main droplet. This is because a reduced speed distribution occurs with respect to the speed of the main droplet, the reduced speed distribution being caused by the action force in the direction opposite to the direction of the liquid movement inward to the head side due to the recession of a meniscus resulting from the contraction of a bubble and the deformation of a piezoelectric element (see e.g. Japanese Examined Patent Application Publication No. 59-31944).

FIGS. 2A to 2C illustrate states of droplet discharging resulting from the occurrence of this speed distribution. In the figures, a main droplet is discharged at a speed V1', and a group of smaller satellite droplets are gradually brought into minute droplets, so that the speed thereof become V2, V3, V4, V5, and V6 in descending order (V1'>V2>V3>V4>V5>V6). A droplet having a speed from V4 onward, comes into mist constituted of minute droplets, as described later.

Japanese Laid-Open Patent Applications Nos. 9-1790 and 10-193649, which are applied based on a concept of using the above-described satellite droplets for image forming, in a state individually separated, with respect to the main droplet, disclose the technique which makes variable the dot area to be formed by bringing the satellite droplets close to the main droplet by controlling a drive pulse to an electromechanical transducer for bubble forming. Also, Japanese Laid-Open Patent Applications No. 7-285222, which addresses the problem of satellite droplets that differs from the above-described satellite droplets, and that are obtained by two-time discharges peculiar to a piezoelectric element, discloses a concept that a satellite droplet which is generated by the projection of a meniscus to the outside of the discharge port due to a large residual vibration of the meniscus accompanied with a rebound displacement of an electromechanical transducer (piezoelectric element) after the deformation thereof, is discharged with a weight equal to that of the main droplet provided, and that the satellite droplet is coalesced with the main droplet on a medium so as to overlap the main droplet. However, in this Japanese Laid-Open Patent Applications No. 7-285222, since there is no perception that new satellite droplets further occur after the discharged satellite droplet with a weight equal to that of the main droplet provided, a fundamental solution of satellite droplets has not yet attained. This is because, since a second meniscus projection accompanied with the rebound displacement of the piezoelectric element is utilized, even if a voltage application for a drive is performed only one time, it will be eventually equivalent to performing discharge two times because the piezoelectric type discharge head discharges the liquid of an equal weight. The displacement of the meniscus, therefore, continues even after the second discharge, as a natural result, so that a further satellite droplet will occur.

Minute droplets, which is named mist, and each of which is more minute than a droplet, such as satellite droplet, having a velocity component and a quantity enough to adhere to a paper surface tend to increase in the number as the main droplet decreases in the quantity. As countermeasures against this, only a technical development for removing occurred mists is being conducted. Japanese Examined Patent Application Publication No. 5-57913, and the corresponding U.S. Pat. No. 468,539, which recognize this mist issue, discloses that the problem of the occurrence of a plurality of satellite droplets with respect to a main droplet can be solved by a method wherein all satellite droplets are coalesced with the main droplet by performing first, second, and third pulse drives for a piezoelectric element. The Japanese Examined Patent Application Publication No. 5-57913, does not analyze the mechanism that the satellite drops are coalesced with the main droplet is not analyzed, but discloses a technical concept of allowing the satellite droplets to be coalesced with the main droplet in a space. Also, in U.S. Pat. No. 4,491,851, the condition for preventing the occurrence of satellite droplets by performing first and second pulse drives for a piezoelectric element as in the case of the above patents, and the condition that, even if the satellite droplets are generated, satellite droplets are coalesced with a main drop as being in a high-speed satellite-dot area condition, are disclosed in FIG. 9 relative to the conventional satellite-droplet generation area condition. The above-described patents shows the results wherein satellite droplets are coalesced with a main droplet in midair, but, since each of these results has been acquired by performing plural-time pulse drives for a piezoelectric element, each of these methods is not practical for performing a high-speed recording or a high-frequency discharging because of an elongated driving time. On the other hand, Japanese Patent Application No. 2000-227081, which proposes means for coalescing a satellite droplet with a main droplet by a discharging method using an electrothermal transducer which forms a bubble, discloses a method wherein a satellite droplet is coalesced with a main droplet by increasing the speed of the satellite droplet by a movable member displaced by one-time bubble forming.

The technical level of the conventional arts recognized from the foregoing is such that plural-time displacements for discharging satellite droplets are performed with respect to a piezoelectric element. The mainstream of the conventional arts is the technique of integrating occurred satellite droplets into a main drop in response to the driving conditions for providing the above-described plural-time deformations to the piezoelectric element. However, the plural-time deformations for discharge with respect to the piezoelectric element runs counter to the increasing of the driving frequency, and delays the return of the meniscus after discharging to the steady state. Therefore, this counteracts the improvement in the print speed by a high-speed and high-frequency drive. In addition, rebound displacements occur after the plural-time displacements of the piezoelectric element, as a natural result, thereby generating further satellite droplets. This constitutes a dilemmatical problem. Particularly, in the Japanese Laid-Open Patent Applications No. 7-285222, since the piezoelectric element is given a drive such as to make the satellite droplet one having an equal quantity as the main droplet which has discharged the satellite droplet, the same satellite droplet problem as conventional one, that is, a dilemmatical problem incapable of solution arises.

Judging from the foregoing, the conventional arts are only at a technical level at which satellite droplets are used so as to eventually enlarge the shot image of a main droplet when viewing the image, since the image is formed with satellite droplets coalesced with or brought close to the main droplet.

Anyhow, at the level of the conventional arts, there is provided no solution as to how to position a satellite drop group relative to a main drop in order to perform a high-speed discharge or a high-pressure discharge.

From another viewpoint, no technical attention has been directed toward a technical problem as to how mists, i.e., minute satellite droplets are prevented from occurring in order to obtain a high-quality color image formed by high-speed and minute droplets, and no solution to this technical problem has been proposed.

SUMMARY OF THE INVENTION

Accordingly, it is an main object of the present invention to provide a novel method for forming droplets capable of operation of a liquid discharge element, i.e., bubble formation by means of an electrothermal transducer, and a high-speed discharge or a high-pressure discharge, while elucidating the liquid discharging mechanism.

It is another object of the present invention to provide an innovative liquid discharging method and a head used therefor which are capable of achieving two-droplet discharge which is superior in the endurance and stable despite of a one-time operation of discharge element based on an unprecedented concept, by directing attention toward a satellite droplet group, as distinguished from a main droplet, the satellite group having been discharged in a state integrated into an antecedent discharged droplet as a main drop, and the satellite droplet group being separated from the main droplet in a space. It is still another object to provide a satellite droplet brought into a minute droplet with a quantity equal to the main droplet and with a desired discharging characteristic equal thereto, even though the discharge element itself is driven in one-drive condition, while directing attention toward the overall satellite group as shown in FIGS. 1A to 1G and utilizing a satellite droplet group which occur as a natural result, when assuming that the main droplet itself is minute in the quantity as in the color droplet, as usual.

In order to achieve the above-described object, the present invention, in a first aspect, provides a liquid discharging method for a liquid discharge head which includes a discharge port constituting the portion for discharging liquid, an energy generating element generating the energy for discharging liquid, and liquid flow paths communicating with the discharge port and having the energy generating element, and which discharges liquid from the discharge port by the energy of the energy generating element. This liquid discharging method comprises the step of projecting a liquid column from the discharge port; the step of discharging the liquid column after a main droplet has separated, and separating the liquid column into a plurality of satellite droplets; and the step of coalescing the plurality of satellite droplets.

In accordance with a second aspect, the present invention provides an image forming method for a liquid discharge head which includes a discharge port constituting the portion for discharging liquid; an energy generating element generating the energy for discharging liquid; and liquid flow paths communicating with the discharge port and having the energy generating element, which forms a plurality of droplets by discharging the liquid from the discharge port by the energy of the energy generating element, and which forms an image by forming a plurality of dots by shooting the plurality of droplets onto a recording medium. In this image forming method, the plurality of dots is formed of a main droplet which flies at the start; and a droplet formed by making capture and coalesce a plurality of satellite droplets discharged as a result of the discharge action of the main droplet, before the satellite droplets have been shot onto the recording medium.

In accordance with a third aspect, the present invention provides an image forming method for a liquid discharge head which includes a discharge port constituting the portion for discharging liquid; an energy generating element generating the energy for discharging liquid; and liquid flow paths communicating with the discharge port and having the energy generating element, which forms a plurality of droplets by discharging the liquid from the discharge port by the energy of the energy generating element, and which forms an image by forming a plurality of dots by shooting the plurality of droplets onto a recording medium. In this image forming method, an image is formed by using a pair of reactive inks constituted of a black ink and a color ink as the liquid, and by superimposing a plurality of dots of the color ink on each dot of the black ink, the dots of the color ink being smaller than the dots of the black ink.

In accordance with a fourth aspect, the present invention provides a liquid discharge apparatus, comprising a liquid discharge head which includes a discharge port constituting the portion for discharging liquid, an energy generating element generating the energy for discharging liquid, and liquid flow paths communicating with the discharge port and having the energy generating element, which forms a plurality of droplets by discharging the liquid from the discharge port by the energy of the energy generating element, and which performs recording by shooting the plurality of droplets onto a recording medium, and a carriage for conveying the liquid discharge head relative to the recording medium. In this liquid discharge apparatus, the liquid discharge head forms the plurality of droplets using a main droplet which flies at the start, and a droplet formed by making capture and coalesce a plurality of satellite droplets discharged as a result of the discharge action of the main droplet, before the satellite droplets have been shot onto the recording medium; and the liquid discharge head shoots the plurality of droplets onto the recording medium with a space interposed therebetween.

In accordance with a fifth aspect, the present invention provides a liquid discharge head which includes a discharge port constituting the portion for discharging liquid; an energy generating element generating the energy for discharging liquid, and liquid flow paths communicating with the discharge port and having the energy generating element, which forms a plurality of droplets by discharging the liquid from the discharge port by the energy of the energy generating element, and which performs recording by shooting the plurality of droplets onto a recording medium. In this liquid discharge head, the plurality of dots is formed of a main droplet which flies at the start; and a droplet formed by making capture and coalesce a plurality of satellite droplets discharged as a result of the discharge action of the main droplet, before the satellite droplets have been shot onto the recording medium.

Further objects, features and advantages of the present invention will become apparent from the following description of the preferred embodiments with reference to the attached drawings.

DESCRIPTION OF THE PREFERRED EMBODIMENTS

First Embodiment

Figure 1A:
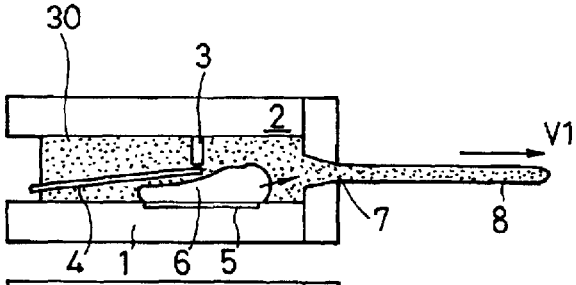
FIGS. 1A to 1G are sectional views of a liquid discharge head in accordance with a first embodiment of the present invention, the sectional views being taken along the liquid flow path direction, wherein processes of liquid discharging are illustrated in sequence.

FIGS. 1A to 1G are sectional views taken along the liquid flow path direction of a liquid discharge head in accordance with a first embodiment of the present invention, wherein characteristic phenomena in liquid flow paths are illustrated separately in processes from FIGS. 1A to 1G.

First, a liquid discharge head in accordance with this embodiment will be described.

Referring to FIGS. 1A to 1G, in the liquid discharge head as a discharge energy generating element for discharge liquid, a heating unit 5 is provided on a smooth element substrate 1, and liquid flow paths 30 are disposed on the smooth element substrate 1 so as to face the heating unit 5. The liquid flow paths 30 communicates with a discharge port 7, as well as communicates with a common liquid chamber for supplying liquid to a plurality of liquid flow paths 30 on the opposite side of the discharge port 7, and receive from this common liquid chamber the liquid commensurating in the quantity with the liquid discharged from the discharge port 7. The meniscus of the liquid charged into the liquid flow paths 30 is formed so that the capillary force occurring at the discharge port 7 and along the inner walls of the liquid flow paths 30 communicating with the discharge port 7, commensurates with the inner pressure (generally exhibiting a negative pressure) of the common liquid chamber, in the vicinity of the discharge port 7.

The liquid flow paths 30 are formed by jointing the element substrate 1 having the heating unit 5 to a top plate 2. In the area in the vicinity of the interface where the heating unit 5 and the liquid to be discharged are in contact, there exists a bubble generating area which makes the liquid to be discharged generate a bubble when the heating unit 5 is rapidly heated. A movable member 4 is disposed in the liquid flow paths 30 having this bubble generating area so that at least one portion thereof faces the heating unit 5. The movable member 4 is a kind of one-end supported cantilever shape which has a free end on the downstream side toward the discharge port 7, and which is supported by supporting member disposed on further toward the upstream side than the liquid flow paths 30. Particularly in this embodiment, the free end is positioned in the vicinity of the center of the bubble generating area, or of the heating unit 5 in order to suppress the growth of a half of the bubble on the upstream side, the half of the bubble influences back wave toward the upstream side and the inertia of the liquid. The movable member 4 can be displaced relative to the supporting member in accordance with the growth of the bubble occurring in the bubble generating area. The fulcrum when the movable member is displaced is the end portion of the supporting portion of the movable member 4 in the supporting member.

A stopper (controlling portion) 3 is positioned at the upper portion of the center of the bubble generating area, and controls the displacement of the movable member 4 so as to be within a given range in order to suppress the growth of a half of the bubble on the upstream side. In the liquid flow from the common liquid chamber to the discharge port 7, a low flow-path resistance area, which has a flow-path resistance lower than that of the liquid flow paths 30, is provided on the upstream side with respect to the stopper 3. The flow path structure in the low flow-path resistance area is arranged so as to reduce the flow path resistance to the liquid movement, by eliminating an upper wall therefrom and by enlarging the cross area of the flow paths.

With the above-described configuration, a head structure is proposed which is characterized in that the liquid flow toward the upstream side of liquid flow paths and the bubble growth toward the upstream side thereof are inhibited by the displaced movable member 4. Next, the discharging operation of the liquid discharge head in accordance with this embodiment will be described in detail. In FIGS. 1A to 1G, the appearances are illustrated wherein a main droplet and a droplet formed by coalescing a group of satellite drops are shot onto a recording medium by a one-time discharge action. Also, in FIG. 6, the variations of the volume of the bubble 6 and the displacement quantity of the movable member 4 in this time are illustrated.

FIG. 1A shows the state wherein an energy such as electrical energy is applied to the heating unit 5, and wherein a bubble is thereby expanding. When applying electrical pulses to the heating unit 5, a portion of the liquid filling the bubble generating area is heated by the heating unit 5, a bubble 6 occurs as a result of a film boiling, and the bubble grows and the volume thereof increases with time. At this time, the displacement of the movable member 4 starts later than the variation of the bubble 6 in the volume due to the rebound force of the movable member 4.

As the bubble 6 grows, the movement of the liquid toward the upstream side, i.e., toward the common liquid chamber occurs, and this movement grows into a large flow because of the presence of the low flow-path resistance area. However, when the movable member 4 is displaced until it approaches or contacts the stopper 3, further displacement thereof is restricted, so that the liquid movement is also significantly suppressed there. More specifically, in the state wherein the movable member 4 is displaced, the resistance to the flow toward the upstream side of the liquid flow paths 30 (at least further toward the upstream side than the center of the bubble generating area) increases, thereby largely suppressing the communication of the liquid and bubble between the liquid flow paths 30 and the common liquid chamber situated at the upstream side thereof. As a result, the growth of the bubble 6 toward the upstream side is also inhibited by the movable member 4. However, since the moving force of the liquid toward the upstream side is large, the movable member 4 is kept in a deflected state under a large stress which pulls the movable member 4 toward the upstream side, and during which the bubble 6 grows up to the maximum volume thereof as described above.

When the bubble 6 in the bubble generation area has grown up to the maximum volume thereof, the liquid within the liquid flow paths 30 moves toward the downstream side and upstream side, due to the pressure on the basis of the generation of the bubble 6. On the upstream side, the movable member 4 is displaced by the growth of the bubble 6, while on the downstream side, discharged liquid 8 is ejected from the discharge port 7 in a column shape. This is because the discharge port 7 is small, and the discharge power is sufficiently large. Herein, the tip of the ink column 8 is flying at a speed V1.

In this embodiment, the portion between the part on the discharge port side of the bubble 6 and the discharge port is in a state wherein a straight flow-path structure with respect to the liquid flow is kept, so to speak, a "linear communicating state". It is more preferable to create an ideal state wherein discharging conditions such as the discharge direction and/or discharge speed of a discharged liquid are stabilized at an extremely high level, by making linearly agree the propagation direction of the pressure wave generated at bubble generation, the flow direction of the liquid accompanied therewith, and the discharge direction.

By way of a definition for achieving the above-described ideal state or a state close thereto, this embodiment is configured so that the heating unit 5, particularly the discharge port 7 side of the heating unit 5 (i.e., the downstream side thereof), which has an influence particularly on the discharge port 7 side of the bubble 6, is directly connected to the discharge port 7 in a straight line. This configuration is in a state wherein, if there is no liquid within the liquid flow paths 30, the heating unit 5, particularly the downstream side thereof can be observed from the outside of the discharge port 7.

Figure 1B:
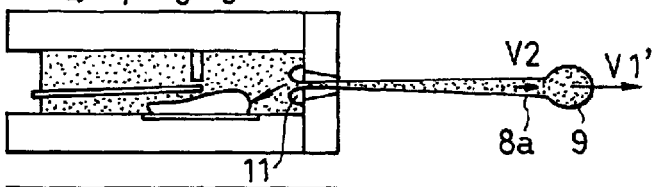
Figure 1C:
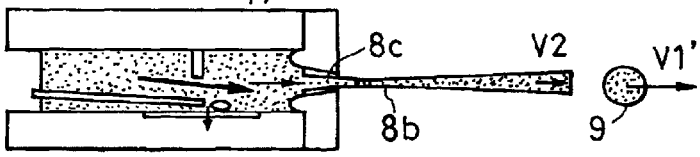

Then, as shown in FIG. 1B, after the above-described film boiling, the force by the negative pressure inside the bubble 6 overcomes the moving force of the liquid toward the downstream side in the liquid flow paths 30, and the contraction of the bubble 6 starts. At this time point, since the force toward the upstream side of the liquid due to the growth of the bubble 6 largely remains, because of the pressure difference between the upstream side and downstream side caused by the interposition of the movable member 4, the movable member 4 still remains in contact with the stopper 3 for a given time after the start of the contraction of the bubble 6, and in many cases, the contraction of the bubble 6 causes the movement of the liquid from the discharge port 7 toward the upstream side. More specifically, when the bubble has grown up to the maximum volume thereof, the flow resistance on the upstream side in the liquid flow paths 30 is increased by the contact between the displaced movable member 4 and the stopper, and the contraction energy of the bubble 6 acts as a force moving the liquid in the vicinity of the discharge port toward the upstream side. At this time point, therefore, the meniscus is pulled from the discharge port 7 into the liquid flow paths 30, thereby pulling in the liquid column toward the discharge port side with a strong power. As a result, a constricted portion occurs in the vicinity of the tip of the discharged droplet, and the discharged droplet tapers away toward the root thereof.

Thereafter, as a granulation phenomenon of the ink due to the surface tension the ink itself, the tip of the ink column 8 flies at a speed V1' in the form of an independent drop, i.e., the main droplet 9. The tip 8*a* of the ink column flies at a speed V2, but V2 becomes smaller than V1', since the ink column is subjected to the force of the pull-in component (see FIG. 1C). Due to the downward displacement of the movable member 4 as a result of the contraction of the bubble, the ink on the ink supply system side start to be supplied at a dash. At this time, a velocity component in the discharge direction is given to the rear end 8*c* of the ink column 8 by a high-speed refill. The rear end 8*c*, therefore, has a speed larger than V2, and the portion 8*b* wherein the speed of the ink column 8 is the smallest, assumes a constricted shape.

Although the ink column 8 is accelerated by the high-speed refill, the movable member 4 is displaced upward by a rebound, and blocks the liquid flow paths, thereby reducing a refill quantity, so that the overall flow of the ink is slowed down, and that the ink column 8 and the meniscus 11 are divided from each other.

Figure 1D:
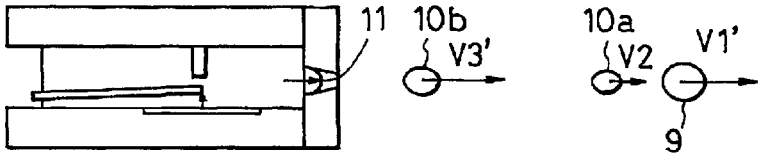

In FIG. 1D, due to granulation, the ink column 8 are divided into two, i.e., a front-end satellite droplet 10*a* and a rear-end satellite droplet 10*b*. The speed V3' of the rear-end satellite droplet 10*b* at this time is represented by V1'>V3'>V2.

Figure 1E:
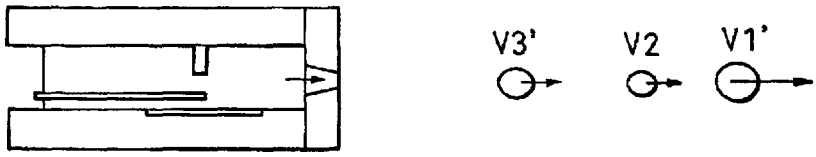
Figure 1F:
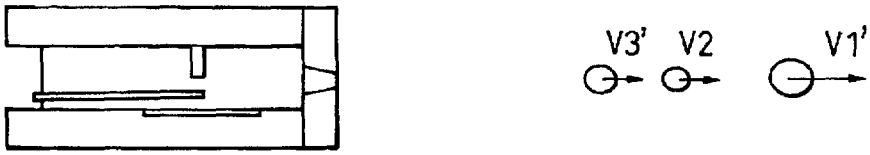
Figure 1G:
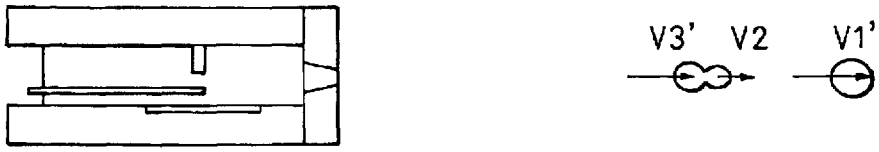
Figures 2A, 2B, 2C:
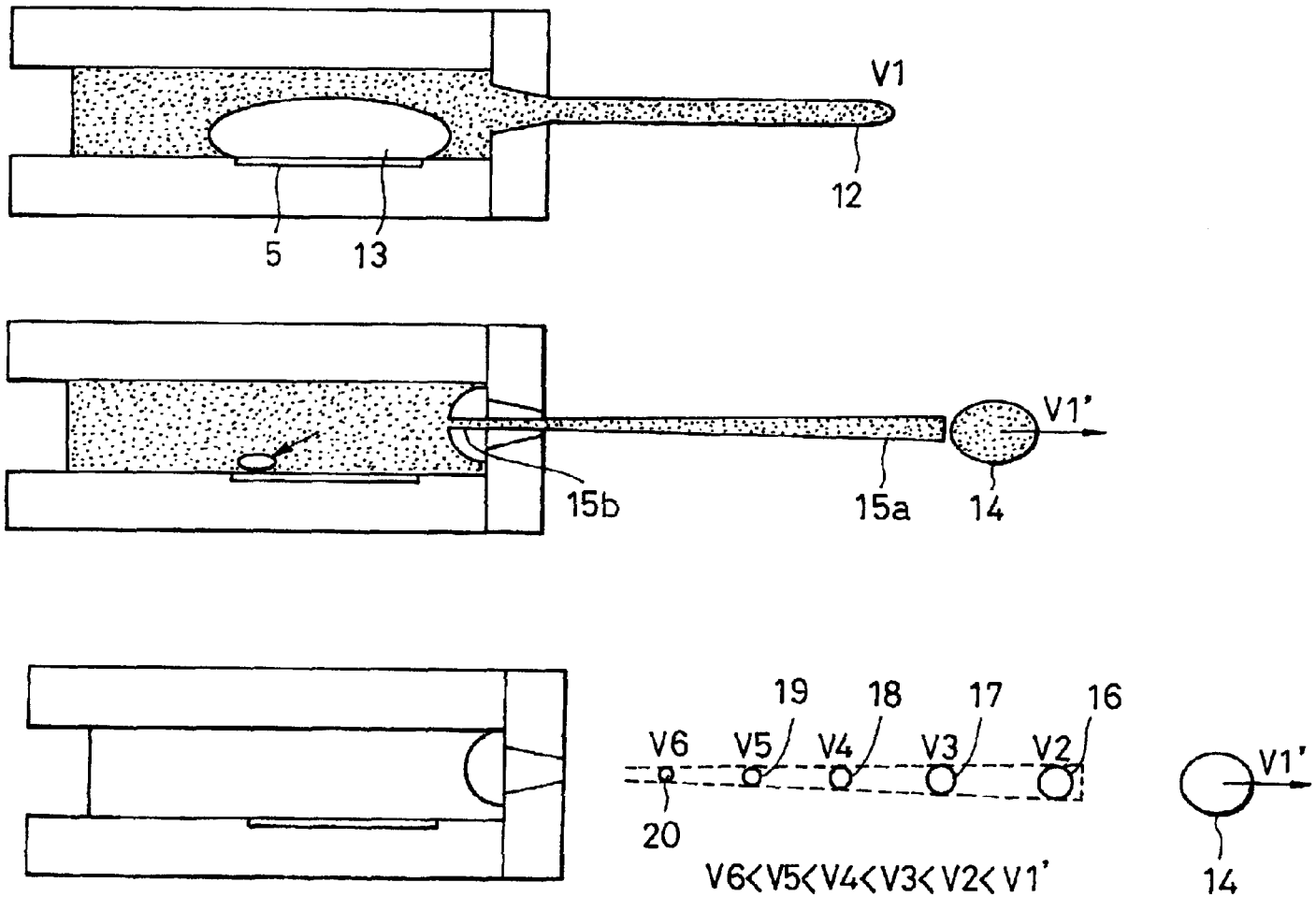
FIGS. 2A to 2C are sectional views of a conventional liquid discharge head taken along the liquid flow path direction.
Figure 3A:
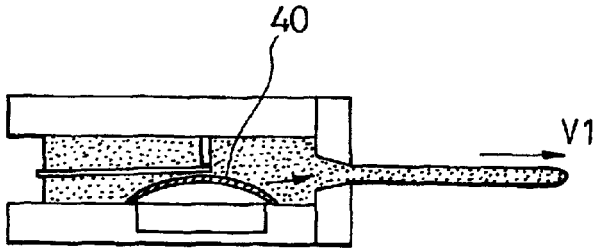
FIGS. 3A to 3G are sectional views of a liquid discharge head in accordance with a second embodiment of the present invention, the sectional views being taken along the liquid flow path direction, wherein processes of liquid discharging are illustrated in sequence.
Figure 3B:
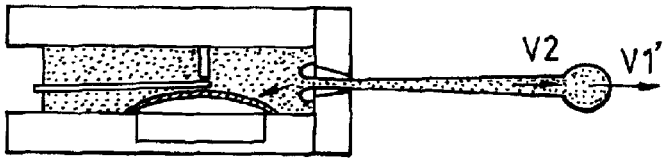
Figure 3C:
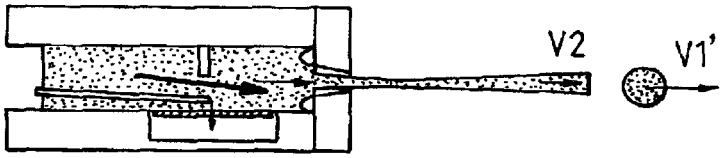
Figure 3D:
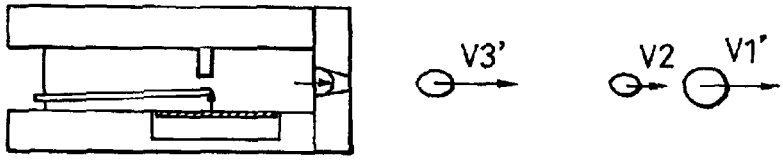
Figure 3E:
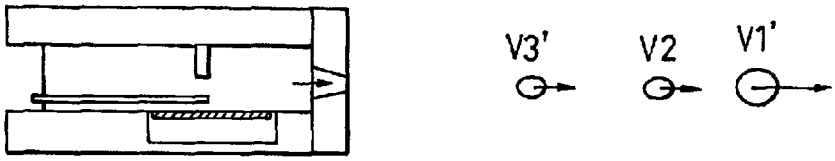
Figure 3F:
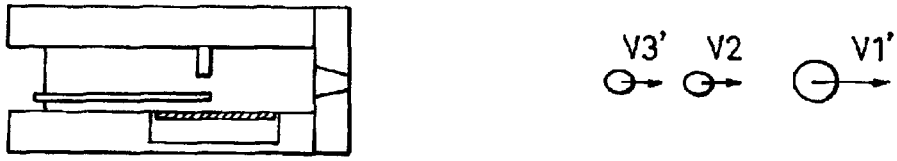
Figure 3G:
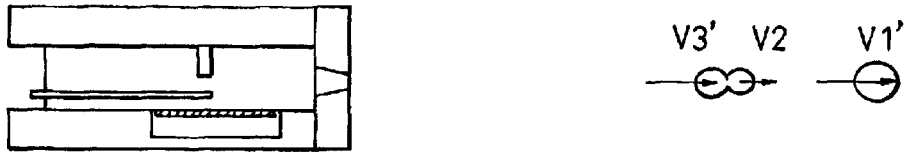
Figure 4A:
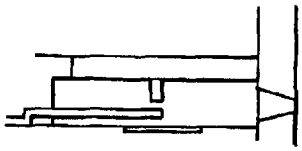
FIGS. 4A to 4H are sectional views of a liquid discharge head in accordance with a third embodiment of the present invention, the sectional views being taken along the liquid flow path direction.
Figure 4B:
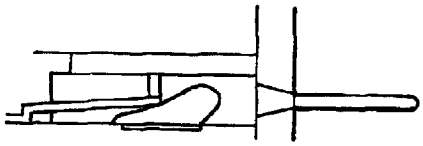
Figure 4C:
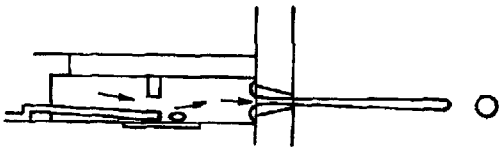
Figure 4D:
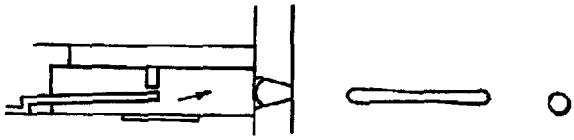
Figure 4E:
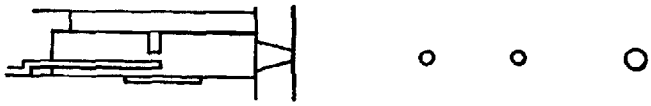
Figure 4F:
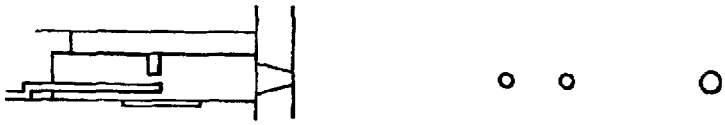
Figure 4G:
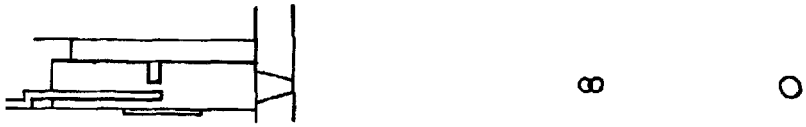
Figure 4H:
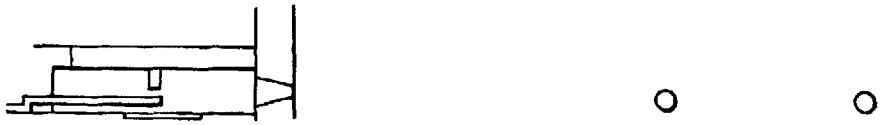

In FIG. 1E, the rear-end satellite droplet 10*b* runs after the front-end satellite droplet 10*a* and approaches it. In FIG. 1F, once the two satellite droplets 10*a* and 10*b* have become close to each other, they are subjected to the influence of a slip stream, and the approaching speed thereof becomes larger. As a consequence, as shown in FIG. 1G, the satellite droplets 10*a* is captured by and coalesced with the satellite droplets 10*b* into one droplet. The result is that, as a whole, two droplets, i.e., a main droplet and the one satellite droplet are shot onto a recording medium.

In this manner, in accordance with the present invention, since the main droplet and the satellite droplets are separated by a small discharge bore and a large power, and further the plurality of satellite droplets is coalesced after capturing, two stable dots without mist can be formed.

Second Embodiment

In the above-described first embodiment, description has been made of the configurations of the discharge head wherein an electrothermal transducer is used. FIGS. 3A to 3G shows a discharge head in accordance with a second embodiment of the present invention, wherein a piezoelectric element 40 is used in place of the electrothermal transducer. As can be seen from the figures, when the piezoelectric element 40 is used, two stable dots without mist can be formed, as in the case of the first embodiment.

Third and Fourth Embodiments

In FIGS. 4A to 4H, and FIGS. 5A to 5H, discharge heads in accordance with third and fourth embodiments of the present invention are shown, respectively. The third and fourth embodiments are each modifications of the first embodiment, and their dimensions are identical with each other. FIGS. 4A to 4H, and FIGS. 5A to 5H illustrate the appearances of liquid discharges when a drive voltage is set to 27 V under the dimensional conditions common to the third and fourth embodiments as follows: the area $S_0$ of a discharge port=140 $\mu m^2$, the size of an electrothermal transducer=18 $\mu$m×50 $\mu$m, EH=50 $\mu$m (EH: the distance from the downstream-side end of the electrothermal transducer to the discharge-port-side end of the element substrate), the size of a movable member=18 $\mu$m×190 $\mu$m×5 $\mu$m (thickness), the gap between the movable member and the electrothermal transducer=4.5 $\mu$m, the length of flow path=250 $\mu$m, the height of the flow path=50 $\mu$m, and the gap between the movable member and a stopper=8 $\mu$m. In FIG. 4 (third embodiment), a drive was performed by a single pulse (pulse width: 1.5 $\mu$s), while in FIG. 5 (fourth embodiment), a drive was performed by double pulses (a preliminary pulse width: 0.4 $\mu$s, an interval time: 2.3 $\mu$s, and a main pulse width: 1.2 $\mu$s). The overall discharge quantity is 5 ng for the discharge head configuration in FIG. 4 (third embodiment), and 6 ng for the discharge head configuration in FIG. 5 (fourth embodiment).

Figure 5A:
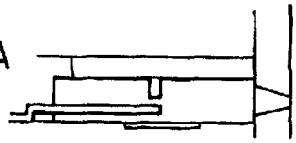
FIGS. 5A to 5H are sectional views of a liquid discharge head in accordance with a fourth embodiment of the present invention, the sectional views being taken along the liquid flow path direction.
Figure 5B:
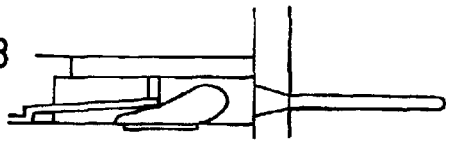
Figure 5C:
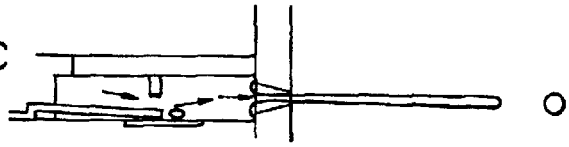
Figure 5D:
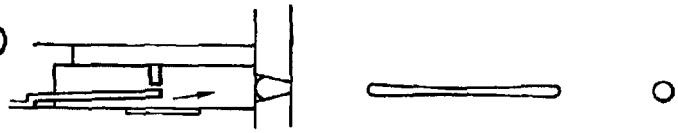
Figure 5E:
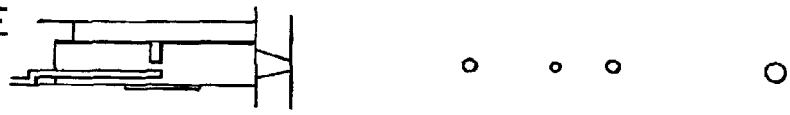
Figure 5F:
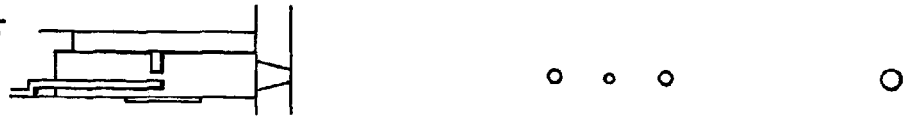
Figure 5G:
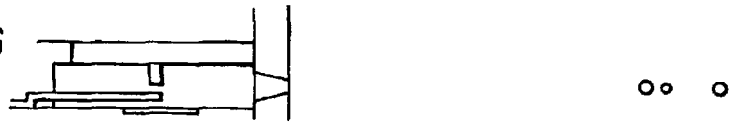
Figure 5H:
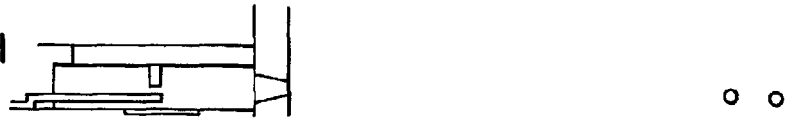

In either case, a plurality of satellite droplets is coalesced after capturing, two stable dots constituted of a main droplet and a satellite droplet can be formed. (Meanwhile, FIG. 5H shows the state immediately before the two satellite droplets has coalesced into one droplet.)

Figure 6:
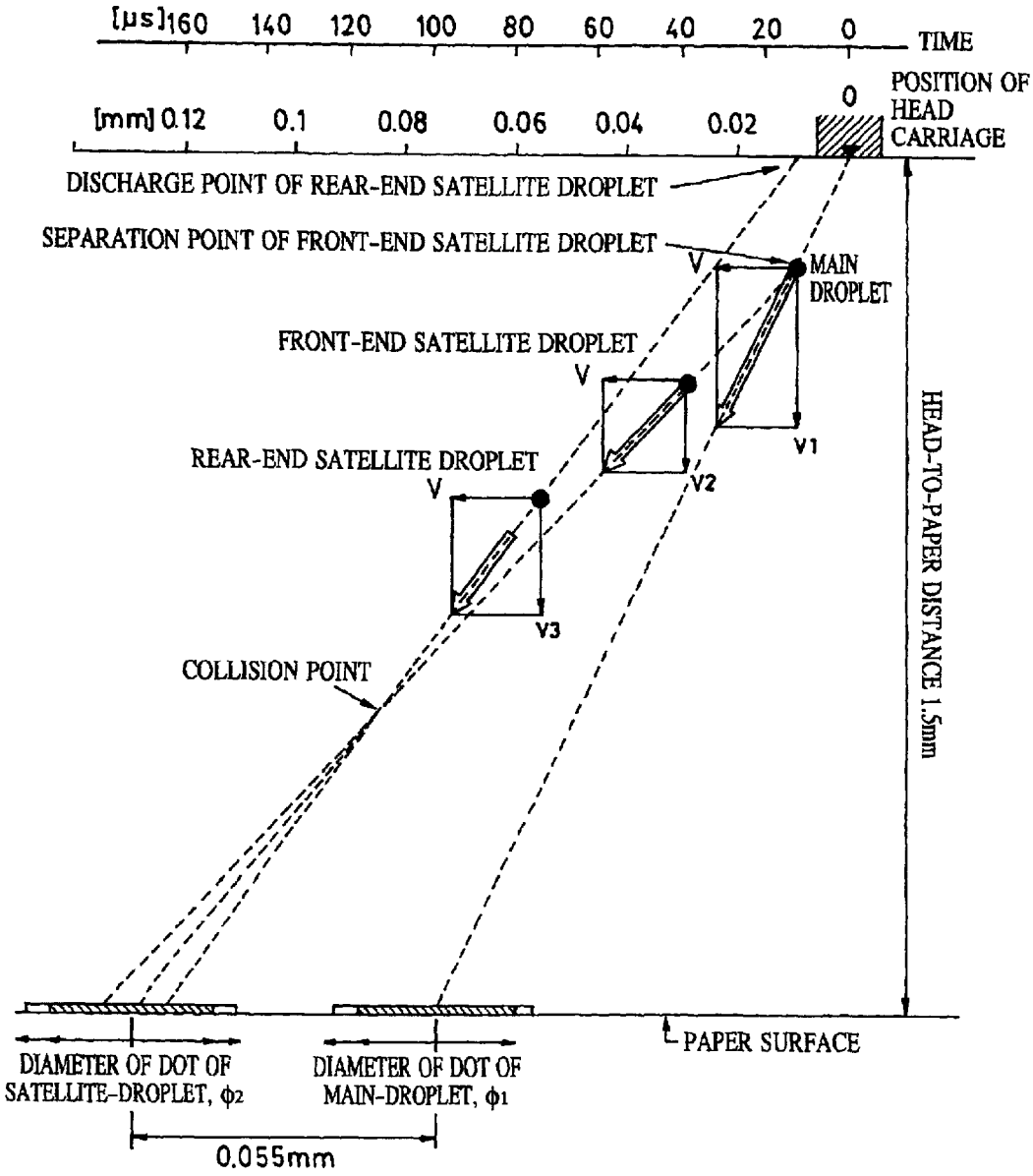
FIG. 6 is a diagram showing the relationship among a carriage carrying a head, paper as a recording medium, and discharged droplets.
Figure 7:
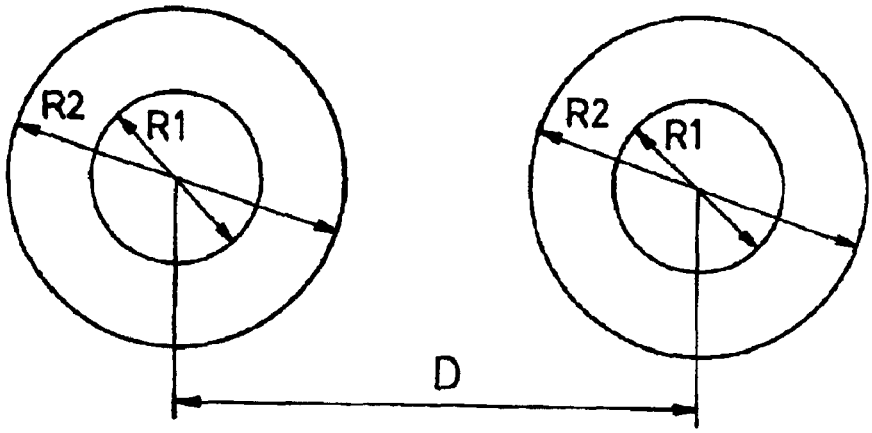
FIG. 7 is a diagram showing two dots shot onto paper by the liquid discharge head in accordance with the fourth embodiment of the present invention.

FIG. 6 is a diagram showing the relationship among a carriage carrying a head, paper as a recording medium, and discharged droplets. In the figure, when the distance between the head and the paper is 1.5 mm, and the moving speed of the carriage is 0.762 m/s (30 in./s), for the case of the configuration in FIG. 5 (fourth embodiment), the speeds of discharged droplets are as follows: V1=15 m/s, V2=10 m/s, V3=8 m/s. On the other hand, for the case of the configuration in FIG. 4 (third embodiment), the speeds of discharged droplets are as follows: V1=13 m/s, V2=7.4 m/s, V3=5.5 m/s. FIG. 7 illustrates dots on paper in the case of the configuration in FIG. 5 (fourth embodiment). Herein, two dots have substantially equal diameters, and the distance D between the two dots is 55 $\mu$m, the diameter R1 of each of the droplets is 18 $\mu$m, and the diameter R2 of each of the dots on the paper (bleeding rate: 2.0) is 36 $\mu$m. It can be seen from the figure that the two dots have been shot on the paper in good conditions.

Other Embodiments

Next, cases where reactive inks are each used as discharge liquids for use in liquid discharge head will be described.

In an ink jet recording apparatus, typically, an overlay-type ink is used as a black ink, and a penetration-type ink is used as a color ink in order to make the black character quality and the color image quality compatible with each other. It is known that a reactive ink is used for preventing the bleeding between a black ink and a color ink, and that the bleeding can be prevented by recording a reactive color image under a black image or at the portion adjacent thereto. From the viewpoint of preventing the bleeding by allowing the black ink and the color ink to react with each other, the discharge rates of the black ink and the color ink are also important. However, when the discharge rates of the two inks are equal, it is important that they react with each other over a wide range of area on paper.

Figures 8A, 8B, 8C, 8D, 8E:
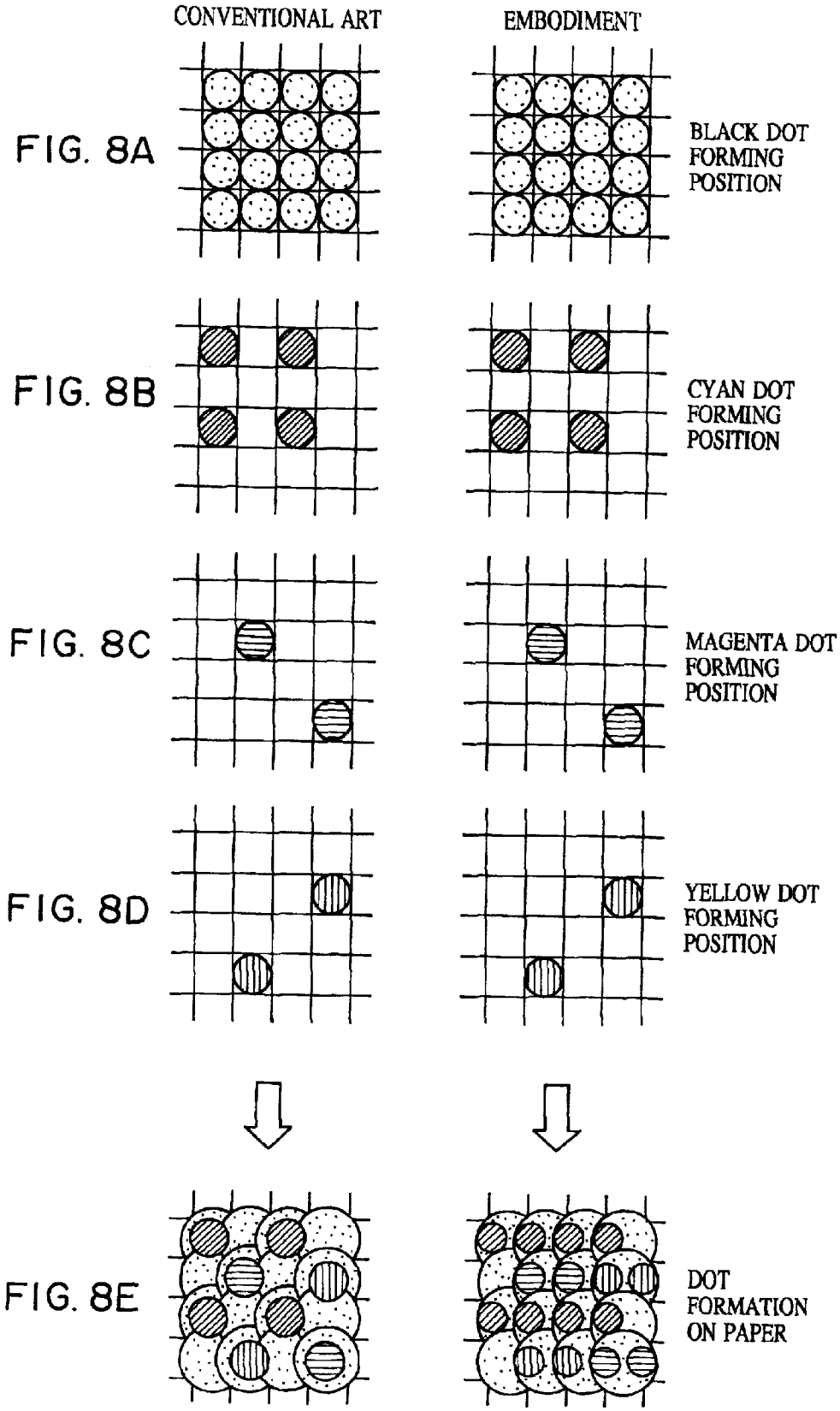
FIGS. 8A to 8E are views showing a black ink underlaid with color inks in a conventional example and embodiments of the present invention.
Figures 9A, 9B, 9C, 9D, 9E:
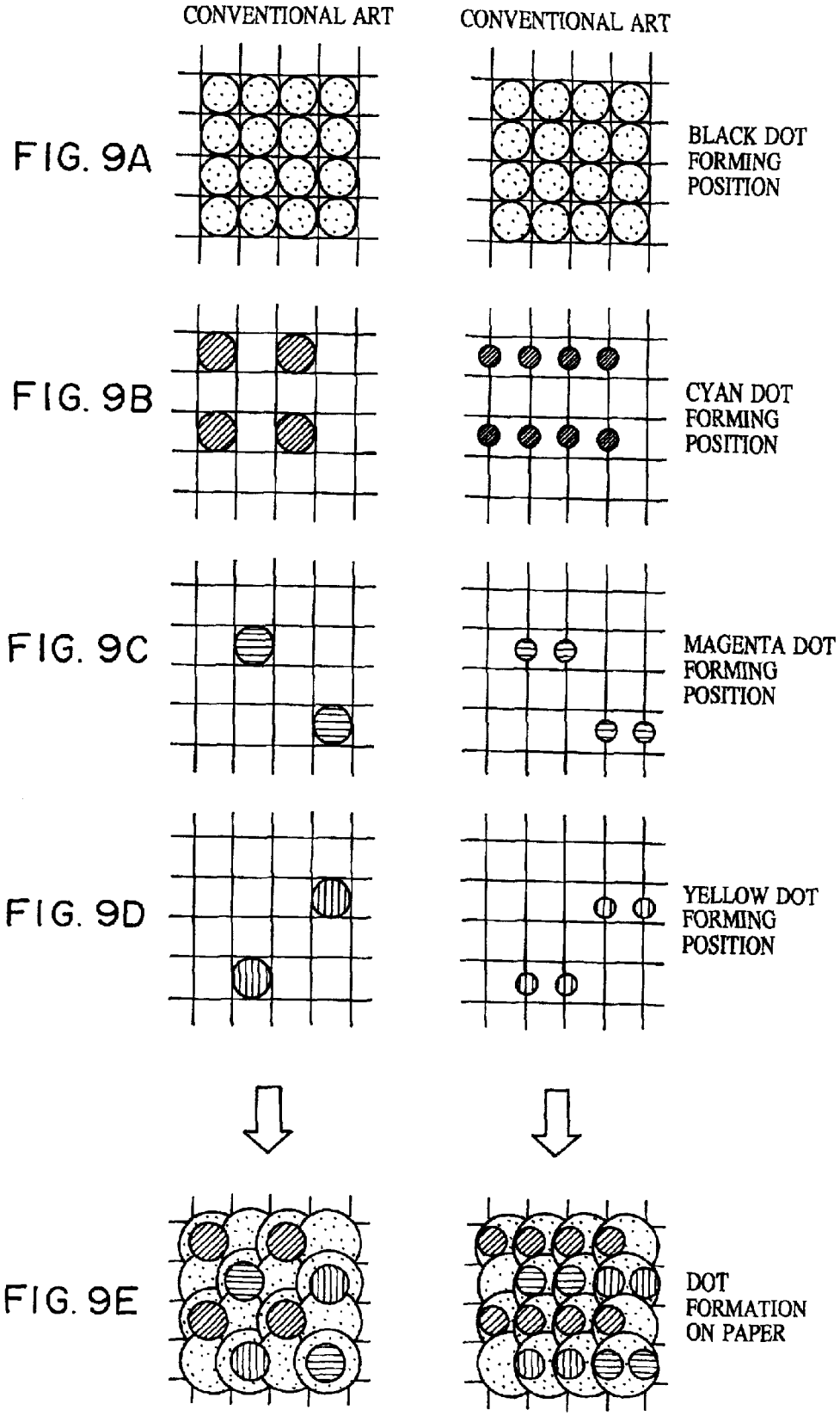
CONVENTIONAL ART FIG. 9A
FIGS. 9A to 9E are views showing modifications of the embodiment in accordance with the present invention shown in FIGS. 8A to 8E.

FIGS. 8A to 8E illustrate the underlaid state of color inks by a conventional art and the underlaid state of color inks by a novel technique in accordance with an embodiment of the present invention. FIGS. 8A to 8D show the forming positions of black dots, cyan dots, magenta dots, and yellow dots, respectively. FIG. 8E shows the dot forming positions on paper with respect to the image recording positions in data. Here, appearances wherein dots are formed while spreading on the real paper, are schematically illustrated. As shown in FIGS. 8A to 8E, the novel technique in accordance with this embodiment allows two recording dots to be recorded by a one-time discharge the conventional art technique, so that each of the recording dots of cyan, magenta, and yellow cover a larger area on the paper. As a result, these reactive inks can effectively react on the surface of the recording medium, thereby efficiently suppressing the bleeding between the black ink and the color ink.

In this embodiment, two recording dots are formed by a one-time discharge. In general, however, supposing the discharge volume at a one-time discharge is identical, it will be efficient in preventing bleeding to disperse a dot into a plurality of dots and to distribute an ink widely and shallowly on paper as shown in FIGS. 9A to 9E.

This embodiment is arranged to form two dots by a one-time drive in consideration of elongating the lifetime of the heater. However, if it is unnecessary to take the lifetime of the head into consideration, it will be possible to distribute an ink widely and shallowly as in the above-described case, by recording dots with a small discharge volume in a predetermined recording area by performing plural-time discharges. This enables the bleeding between the black ink and the color ink to be efficiently suppressed.

Figures 1, 11A:
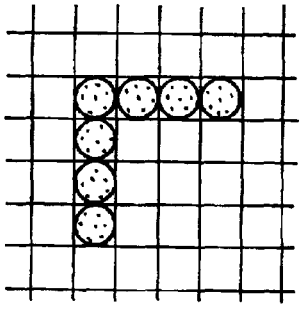
FIGS. 11A and 11B are recording states when the resolution of color inks are higher than those of the black inks in accordance with a conventional example and the embodiment of the present invention.
Figures 2, 11A:
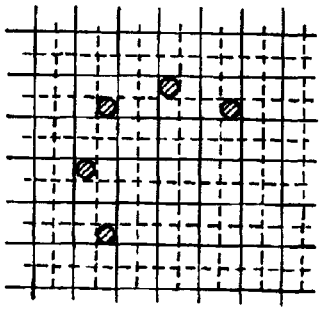
Figures 3, 11A:
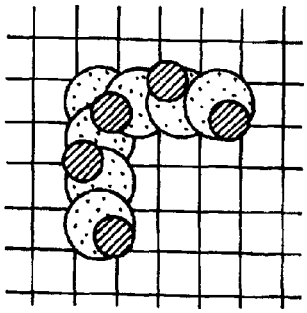
Figures 1, 11B:
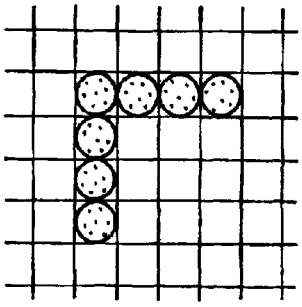
Figures 2, 11B:
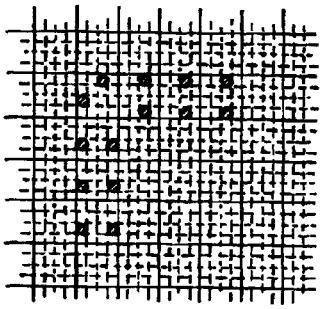
Figures 3, 11B:
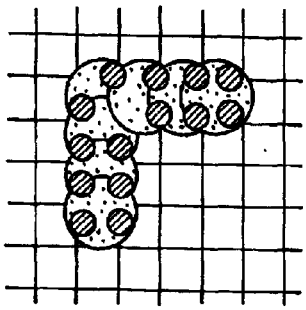

As examples of the foregoing, the recording states in cases where the resolution of the color ink is higher than that of the black ink, are illustrated in FIGS. 11A-1 to 11A-3 and FIGS. 11B-1 to 11B-3. FIGS. 11A-1 to 11A-3 show that a second ink (color ink) has a recording resolution twice as high longitudinally and laterally as those of a first ink (black ink). On the other hand, FIGS. 11B-1 to 11B-3 show that the second ink has a recording resolution four times as high longitudinally and laterally as those of the first ink. In each of the example shown in FIGS. 11A-1 to 11A-3 and the example shown in FIGS. 11B-1 to 11B-3, the discharge volume of the second ink is smaller than that of the first ink, and droplets of the second ink with a small quantity are arranged to be recorded under a plurality of droplets of the first ink. Each of the ink droplets in FIGS. 11A-1 to 11A-3 has a volume four times as large as that in FIGS. 11B-1 to 11B-3, but the ink droplet in FIGS. 11B-1 to 11B-3 covers wider range than that in FIGS. 11A-1 to 11A-3, and thereby can inhibit more efficiently the bleeding between the black ink and the color ink.

Figure 10A:
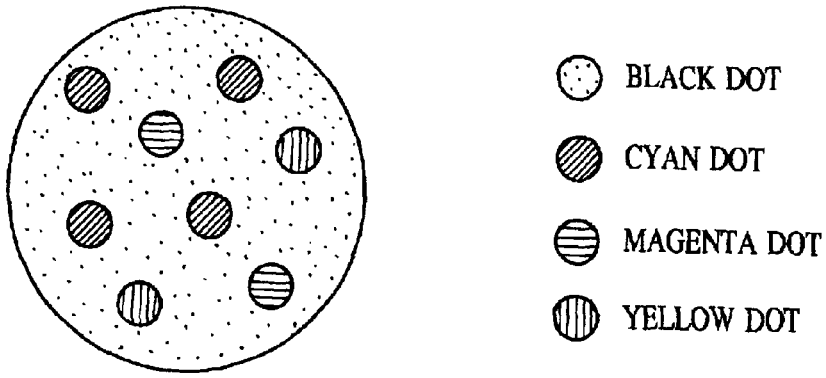
FIGS. 10A to 10C are schematic views showing appearances wherein a black ink is underlaid with cyan, magenta, and yellow inks which react with the black ink.
Figure 10B:
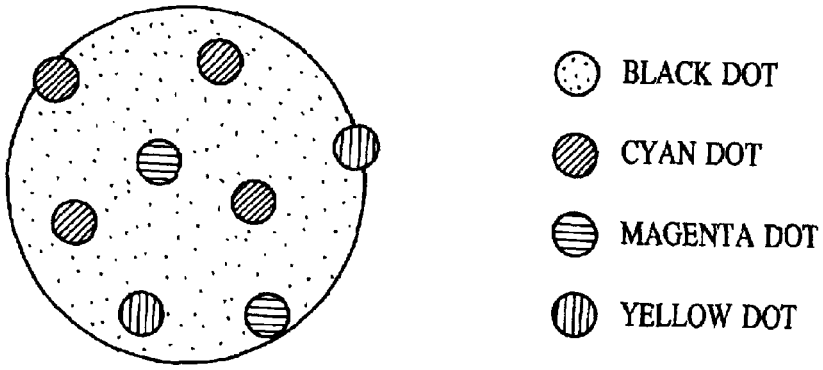
Figure 10C:
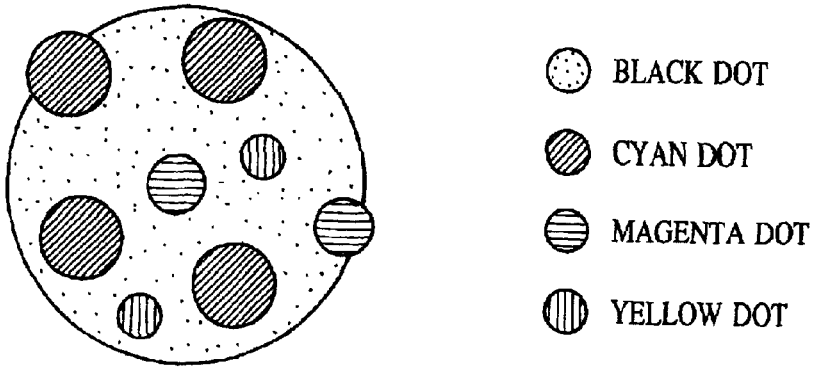

FIGS. 10A to 10C schematically illustrate the appearances wherein the black ink is underlaid with the cyan, magenta, and yellow inks which react with the black ink. These arrangements prevent bleeding and provides a superior recording density balance.

As shown in FIG. 10A, even when the recording dots of the cyan, magenta, and yellow inks exist within the recording dot of the black ink, or as shown in FIG. 10B, even when the recording dots of these color inks exist within the black ink or adjacently thereto, bleeding can be efficiently suppressed. In addition, as shown in FIG. 10C, even when the cyan, magenta, and yellow inks form recording dots different in size from one another, a similar effect can be obtained.

In the above-described examples, it is not necessarily required that all of the cyan, magenta, and yellow inks react with the black ink. If only the black ink is underlaid with the color inks enough to prevent bleeding, a similar bleeding effect will be achieved.

As is evident, in accordance with the present invention, since the main droplet and the satellite droplets are separated by a small discharge bore and a large power, and further a plurality of satellite droplets is coalesced after capturing, it is possible to form two stable dots without mist.

Furthermore, by forming an image using a pair of reactive inks as discharged liquids, bleeding can be prevented more efficiently.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of following claims is to be accorded the broadest interpretation so as to encompass all such modifications and equivalent structures and functions.

What is claimed is:

1. A liquid discharging method for a liquid discharge head which includes a discharge port constituting the portion for discharging liquid, an energy generating element generating the energy for discharging liquid, and liquid flow paths communicating with said discharge port and equipped with said energy generating element, and which discharges liquid from said discharge port by the energy of said energy generating element, said liquid discharging method comprising the steps of:

projecting a liquid column from said discharge port;

separating a main droplet from the tip of said liquid column;

discharging said liquid column after said main droplet has been separated, and separating said liquid column into a plurality of satellite droplets; and coalescing said plurality of satellite droplets.

2. A liquid discharging method in accordance with claim 1, wherein said energy generating element is an electrothermal transducer.

3. A liquid discharging method in accordance with claim 2, wherein said electrothermal transducer is used for generating film boiling phenomena, and wherein said liquid discharge head further comprises a movable member which is displaced by the growth of a bubble due to said film boiling, and a controlling portion for controlling the displacement of said movable member so as to be within a desired range.

4. A liquid discharging method in accordance with claim 3, further comprising the step of separating the main droplet from the liquid column by pulling the liquid which projects through the discharge port into the discharging head when said bubble disappears.

5. A liquid discharging method in accordance with claim 4, further comprising the step of accelerating the liquid column by supplying the liquid to the vicinity of the discharge port by said movable member when said bubble disappears.

6. A liquid discharging method in accordance with claim 5, further comprising the step of separating the portion of the accelerated component of the liquid column by the suppression of the liquid supply by said movable member and the disappearance of the bubble.

7. A liquid discharging method in accordance with claim 6, further comprising the step of recovering minute droplets by the suppression of the liquid supply by said movable member.

8. A liquid discharging method in accordance with claim 1, wherein the weight of the droplet formed by coalescing a plurality of satellite droplets after capturing, is not less than 1 ng.

9. A liquid discharging method in accordance with claim 1, wherein the discharge speed of said main droplet is 13 to 20 m/s while that of the coalesced satellite droplet is 6.5 to 10 m/s, and wherein the weight of said coalesced satellite droplet is not less than 1 ng.

10. A liquid discharging method in accordance with claim 1, wherein the relationship: V1>V3>V2 is satisfied, when the flight speed of said main droplet is V1, that of a front satellite droplet of said plurality of satellite droplets is V2, and that of a rear satellite droplet of said plurality of satellite droplets is V3.

11. A liquid discharging method in accordance with claim 1, wherein said energy generating element is an electromechanical transducer.

12. A liquid discharging method in accordance with claim 1, wherein the flight speed of said main droplet is larger than that of the droplet formed by coalescing a plurality of satellite droplets.

13. An image forming method for a liquid discharge head which includes a discharge port constituting the portion for discharging liquid, an energy generating element generating the energy for discharging liquid, and liquid flow paths communicating with said discharge port and equipped with said energy generating element, which forms a plurality of droplets by discharging said liquid from said discharge port by the energy of said energy generating element, said method comprising the steps of:

forming said plurality of droplets by a main droplet which flies at the start and a droplet formed by coalescing a plurality of satellite droplets which is discharged as a result of the discharge action of said main droplet, before said satellite droplets have reached a recording medium; and forming an image on the recording medium by said plurality of droplets reaching the recording medium.

14. An image forming method in accordance with claim 13, wherein said liquid is formed of a pair of reactive inks.

15. An image forming method in accordance with claim 11, wherein said reactive inks are constituted of a black ink and a color ink.

16. An image forming method for a liquid discharge head which includes a discharge port constituting the portion for discharging liquid, an energy generating element generating the energy for discharging liquid, and liquid flow paths communicating with said discharge port and equipped with said energy generating element, which forms a plurality of droplets by discharging said liquid from said discharge port by the energy of said energy generating element, and which forms an image by forming a plurality of dots by shooting said plurality of droplets onto a recording medium, wherein an image is formed by using a pair of reactive inks constituted of a black ink and a color ink as said droplets, and by superimposing a plurality of dots of said color ink on each dot of the black ink, each of the dots of said color ink being smaller than the dot of said black ink.

17. An image forming method in accordance with claim 16, wherein said color inks comprise yellow, cyan, and magenta inks, and wherein each of said color inks is constituted of a plurality of dots.

18. An image forming method in accordance with claim 13, wherein said main droplet and said droplet formed by coalescing said plurality of satellite droplets reach the recording medium with a space interposed therebetween.

* * * * *

UNITED STATES PATENT AND TRADEMARK OFFICE

CERTIFICATE OF CORRECTION

PATENT NO. : 6,846,054 B2
DATED : January 25, 2005
INVENTOR(S) : Hiroyuki Ishinaga et al.

It is certified that error appears in the above-identified patent and that said Letters Patent is hereby corrected as shown below:

Column 2,
Line 22, “yet” should read -- yet been --;
Line 32, “is named” should read -- form a --;
Line 33, “as” should read -- as a --;
Line 34, “enough” should read -- sufficient --,
Line 40, “468,539” should read -- 4,686,539 --;
Line 41, “discloses” should read -- disclose --; and
Line 59, “shows” should read -- show --.

Column 9,
Line 5, “is” should read -- are --.

Signed and Sealed this

Fourteenth Day of June, 2005

JON W. DUDAS
*Director of the United States Patent and Trademark Office*